United States Patent [19]

Kimble et al.

[11] Patent Number: 4,857,179

[45] Date of Patent: Aug. 15, 1989

[54] ORE FLOTATION AND MINERAL FLOTATION AGENTS FOR USE THEREIN

[75] Inventors: Kenneth B. Kimble, Borger; Gary D. Macdonell, Houston, both of Tex.; Harold W. Mark, Summerville, S.C.

[73] Assignee: Phillips Petroleum Company, Bartlesville, Okla.

[21] Appl. No.: 286,343

[22] Filed: Dec. 19, 1988

[51] Int. Cl.[4] ..... B03D 1/02

[52] U.S. Cl. ..... 209/166; 252/61; 568/61; 568/66

[58] Field of Search ..... 209/166, 167; 252/61; 568/61, 66; 423/26

[56] References Cited

U.S. PATENT DOCUMENTS

| | | | |
|---|---|---|---|
| 3,025,327 | 3/1962 | May et al. | 260/609 |
| 3,538,044 | 11/1970 | Buchholz et al. | 260/45.75 |
| 4,601,818 | 7/1986 | Bresson et al. | 209/166 |
| 4,622,131 | 11/1986 | Bresson et al. | 209/167 |

FOREIGN PATENT DOCUMENTS

| | | | |
|---|---|---|---|
| 1068173 | 1/1984 | U.S.S.R. | 209/166 |

*Primary Examiner*—Kenneth M. Schor
*Assistant Examiner*—Thomas M. Lithgow
*Attorney, Agent, or Firm*—Laney, Dougherty, Hessin & Beavers

[57] ABSTRACT

A process for the recovery of minerals from an ore or concentrate containing the same wherein the minerals are recovered in a froth from an aqueous pulp containing the ore or concentrate and wherein one or more mineral flotation agents are employed in the aqueous pulp to control the type of minerals in the froth is provided. The mineral flotation agents used in carrying out the process comprise compounds formed by the addition of hydrogen sulfide to dicyclopentadiene. In one embodiment, the mineral flotation agents used in carrying out the process comprise tricyclodecenyl mercaptans having one or both of the following structures:

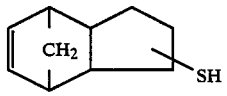

and

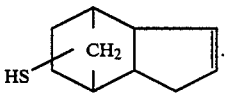

19 Claims, No Drawings

ORE FLOTATION AND MINERAL FLOTATION AGENTS FOR USE THEREIN

BACKGROUND OF THE INVENTION

1. Field of the Invention

This invention relates generally to ore flotation processes, and more particularly, to mineral flotation agents for use in ore flotation processes.

2. Description of the Prior Art

Froth flotation is a commonly employed process for recovering and concentrating minerals from an ore or a concentrate of the ore. In such a process, the ore is crushed and wet ground to obtain a pulp. The pulp is aerated to produce a froth at the surface thereof. Certain minerals contained in the pulp adhere to bubbles of the froth and are carried to the surface of the pulp therewith. Other minerals do not adhere to bubbles of the froth and remain with the tail product or remaining pulp. The minerals adhering to bubbles of the froth are then skimmed or otherwise removed and separated. Both the froth product and the tail product can be further processed to obtain desired minerals. In this way, valuable minerals can be separated from undesired or gangue portions of the ore.

In order to increase the productivity of the process, additives such as mineral flotation agents known in the art as "collectors" and mineral flotation agents known in the art as "depressants" are typically admixed with the pulp together with other additives such as frothing agents, stabilizers and the like. Depressants, also called suppressants, increase the mineral selectivity of the process by reducing the flotation of certain minerals and thereby increasing the production of certain minerals. In other words, depressants selectively inhibit the adherance of certain minerals to the bubbles of the froth thus assisting in the separation of certain minerals from others. Collectors are admixed with the pulp to cause certain minerals contained therein to adhere to bubbles of the froth so that they can be recovered when the froth is skimmed or otherwise removed from the pulp. Typical mineral flotation collectors include xanthates, amines, alkyl sulfates, arenes, sulfonates, dithiocarbamates, dithiophosphates, thiols, and fuel oils. Many depressants and collectors have been developed heretofore.

By the present invention, it has been discovered that compounds formed by the reaction of hydrogen sulfide with dicyclopentadiene are useful as mineral flotation agents in froth flotation processes. Thus, by the present invention, an improved process for the recovery of minerals from an ore or concentrate containing the same is provided.

SUMMARY OF THE INVENTION

By the present invention, a process for recovering minerals from an ore or concentrate containing the same wherein one or more mineral flotation agents are employed to increase the productivity of the process is provided. The mineral flotation agent or agents comprise compounds formed by the reaction of hydrogen sulfide, $H_2S$, with dicyclopentadiene, $C_{10}H_{12}$.

In one embodiment, the mineral flotation agent used in carrying out the process of the present invention comprise tricyclodecenyl mercaptans characterized by one or both of structural formulas (a) and (b) below:

(a)

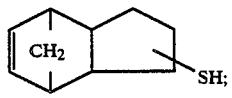

and (b)

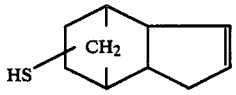

It has been found that compounds formed by the reaction of hydrogen sulfide and dicyclopentadiene are very useful as metal sulfide and metal oxide collectors in froth flotation processes. It has been found that such compounds are particularly useful as collectors for free metals such as gold, Au, and silver, Ag.

It is therefore an object of the present invention to provide an improved process for recovering minerals from an ore or concentrate containing the same.

It is an object of the present invention to provide mineral flotation agents for use in a froth flotation process that improve the overall productivity of the process.

Other objects, features, uses and advantages of the present invention will be readily apparent to those skilled in the art upon a reading of the following description of the preferred embodiments of the invention.

DESCRIPTION OF THE PREFERRED EMBODIMENTS

In accordance with the present invention, a process for recovering minerals is provided. More specifically, a process for recovering minerals from an ore or concentrate containing the same wherein the minerals are recovered in a froth from a aqueous slurry or pulp containing the ore or concentrate and wherein one or more new mineral flotation agents are employed in the slurry or pulp to control the type of minerals in the froth is provided.

By employing one or more new mineral flotation agents, the process of the present invention achieves a level of productivity and other advantages not achieved by other froth flotation processes. Except for the new mineral flotation agents(s) employed, the froth flotation process of the present invention is similar to other froth flotation processes.

The mineral flotation agent(s) used in carrying out the process of the present invention comprise compounds formed by the addition of hydrogen sulfide, $H_2S$, to dicyclopentadiene, $C_{10}H_{12}$. The compounds can be both monomercaptan and dimercaptan addition products.

Preferably, the mineral flotation agent(s) used in carrying out the process of the present invention are tricyclodecenyl monomercaptans formed by the addition of hydrogen sulfide to dicyclopentadiene. More preferably, the mineral flotation agent(s) used in carrying out the process of the present invention comprise tricyclodecenyl monomercaptans having one or both of the following structures (a) and (b) below:

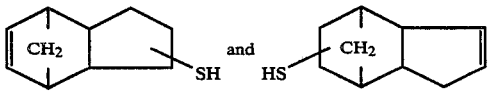

Of course, as will be understood by those skilled in the art, the exact chemical structure of tricyclodecenyl monomercaptans formed by the addition of hydrogen sulfide to dicyclopentadiene varies depending upon which of the two possible forms of dicyclopentadiene is used and upon the particular isomer or isomers formed therefrom. The isomers formed are extremely difficult to separate. Although tricyclodecenyl monomercaptans having one or both of the structures (a) and (b) above preferably predominate, other isomers of the tricyclodecenyl monomercaptan and even other compounds such as tricyclodecenyl dimercaptans may be present in the product formed by the addition of hydrogen sulfide to dicyclopentadiene.

Tricyclodecenyl monomercaptans having one or both of the structures (a) and (b) above can be formed by the ultraviolet light initiated or catalyzed addition of hydrogen sulfide to dicyclopentadiene. The general reaction is depicted below:

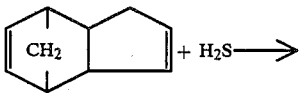

Dicyclopentadiene

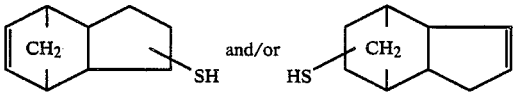

Tricyclodecenyl Mercaptan(s)

Other methods of preparing the tricyclodecenyl mercaptans can be used as well. A method of preparing tricyclodecenyl mercaptans having one or both of the structures (a) and (b) above and in accordance with the general reaction shown above by adding hydrogen sulfide to dicyclopentadiene in the presence of water, a peroxide and either metallic iron, cobalt, or nickel is described in U.S. Pat. No. 3,025,327 issued Mar. 13, 1962, which is incorporated by reference herein.

The froth flotation process of the present invention preferably comprises the steps of crushing ore that contains the minerals to be recovered, mixing the crushed ore, water and at least one compound formed by the addition of hydrogen sulfide to dicyclopentadiene to establish a pulp, aerating the thus established pulp to produce a froth at the surface of the pulp which is rich in certain minerals but depleted of other minerals or the gangue portions of the ore or viceversa, and recovering minerals from either the thus produced froth or tail product. If desired, the mineral flotation agent(s) used in carrying out the process of the present invention can be admixed with the ore before it is crushed or with the pulp after the pulp is established but before it is aerated. Of course, as will be understood by those skilled in the art, many additional flotation and frothing steps can be utilized to ultimately obtain the minerals desired. A variety of flotation agents and processing aids such as frothers, flocculants, dispersants, promoters and the like can be blended with or otherwise used in conjunction with the mineral flotation agent or agents used in carrying out the process of the present invention.

It is generally believed that the mineral flotation agent(s) used in carrying out the process of the present invention are useful for separating any mineral from other minerals or gangue portions of the ore. The agent(s) can be used to separate a mixture of metals contained in a particular mining deposit or ore, the mixture being further separated by subsequent froth flotations or other conventional separating procedures. The mineral flotation agent(s) used in carrying out the process of the present invention are very useful as mineral flotation collectors for free metals such as gold, Au, and silver, Ag, and for metal sulfide and metal oxide materials. Examples of metal bearing materials that can be separated in accordance with the process of the present invention include:

| | |
|---|---|
| Molybdenum-bearing ores: | |
| Molybdenite | $MoS_2$ |
| Wulfenite | $PbMoO_4$ |
| Powellite | $Ca(Mo,W)O_4$ |
| Ferrimolybdite | $Fe_2Mo_3O_{12}.8H_2O$ |
| Copper-bearing ores: | |
| Covallite | $CuS$ |
| Chalcocite | $Cu_2S$ |
| Chalcopyrite | $CuFeS_2$ |
| Bornite | $Cu_5FeS_4$ |
| Cubanite | $Cu_2SFe_4S_5$ |
| Valerite | $Cu_2Fe_4S_7$ or $Cu_3Fe_4S_7$ |
| Enargite | $Cu_3(As,Sb)S_4$ |
| Tetrahedrite | $Cu_3SbS_2$ |
| Tennanite | $Cu_{12}As_4S_{13}$ |
| Cuprite | $Cu_2O$ |
| Tenorite | $CuO$ |
| Malachite | $Cu_2(OH)_2CO_3$ |
| Azurite | $Cu_3(OH)_2CO_3$ |
| Antlerite | $Cu_3SO_4(OH)_4$ |
| Brochantite | $Cu_4(OH)_6SO_4$ |
| Atacamite | $Cu_2C_1(OH)_3$ |
| Chrysocolla | $CuSiO_8$ |
| Famatinite | $Cu_3(Sb,As)S_4$ |
| Bournonite | $PbCuSbS_3$ |
| Lead-bearing ore: | |
| Galena | $PbS$ |
| Antimony-bearing ore: | |
| Stilnite | $Sb_2S_4$ |
| Zinc-bearing ores: | |
| Sphalerite | $ZnS$ |
| Zincite | $ZnO$ |
| Smithsonlite | $ZnCO_3$ |
| Silver-bearing ores: | |
| Argentite | $Ag_2S$ |
| Stephanite | $Ag_5SbS_4$ |
| Hessite | $AgTe_2$ |
| Chromium-bearing ores: | |
| Daubreelite | $FeSCrS_3$ |
| Chromite | $FeO.Cr_2O_3$ |
| Gold-bearing ores: | |
| Sylvanite | $AuAgTe_2$ |
| Calaverite | $AuTe$ |
| Platinum-bearing ores: | |
| Cooperite | $Pt(AsS)_2$ |
| Sperrylite | $PtAs_2$ |
| Uranium-bearing ores: | |
| Pitchblende | $U_2O_5(U_3O_8)$ |
| Gummite | $UO_3.nH_2O$ |

The amount of the mineral flotation agent or agent(s) employed in carrying out the process of the present invention is not critical. The quantity of the mineral flotation agent(s) employed will depend on whether the compound or compounds are being used with an ore or a concentrate containing the ore and upon whether there is a large or small amount of the minerals to be affected thereby. The mineral flotation agent or agents used in carrying out the process of the present invention should be employed at concentration levels sufficient to provide the desired action on certain minerals.

Generally, the amount of the mineral flotation agent or agents employed in carrying out the process of the present invention will range from about 0.005 pounds to about 5 pounds of the mineral flotation agent(s) per ton of solid or crushed ore (lb./ton) in the pulp. Preferably, the amount of the mineral flotation agent or agents employed is in the range of from about 0.01 pounds to about 0.5 pounds of the mineral flotation agent(s) per ton of solids or crushed ore (lb./ton) in the pulp.

The mineral flotation agent or agents used in carrying out the process of the present invention can be admixed with the ore during the ore grinding stage of the process, can be admixed with the crushed ore and water used to establish the pulp or with the pulp during the ore flotation stage of the process, or can be admixed with the concentrate which is to be further processed. Preferably, the agent(s) are admixed with the crushed ore and water used to establish the pulp during the ore flotation stage of the process.

The tricyclodecenyl mercaptan mineral flotation agent(s) used in carrying out the process of the present invention can be used alone or in connection with other mineral flotation agents such as other mineral flotation collectors. The tricyclodecenyl mercaptan mineral flotation agent(s) are very effective for use in combination with other mercaptan mineral flotation agents, particularly dodecyl and decyl mercaptans. When the tricyclodecenyl mercaptan mineral flotation agent(s) of the present invention are blended with other agents, the weight ratio of the tricyclodecenyl mercaptan(s) to the other agents is preferably in the range of from 50:50 to 99.9:0.1. Most preferably, the weight ratio of the tricyclodecenyl mercaptan(s) to other collector employed in the blend is in the range of from 50:50 to 75:25.

Any froth flotation apparatus can be used for carrying out the process of the present invention. Commonly used commercial flotation machines are the Agitar (Galigher Company), Denver Sub-A (Denver Equipment Company) and the Fagergren (Western Machinery Company). Smaller laboratory scale apparatus such as the Hallimond cell can also be used.

The mineral flotation agent(s) used in carrying out the process of the present invention have been used effectively in froth flotation processes conducted at temperatures in the range of from about 50° F. to about 80° F. and under atmospheric pressure. However, any temperature and pressure generally employed by those skilled in the art is within the scope of this invention.

The following examples are provided to further illustrate the effectiveness of the mineral flotation agents used in carrying out the process of the present invention.

EXAMPLE I

This example shows that a tricyclodecenyl mercaptan formed by the addition of hydrogen sulfide to dicyclopentadiene is effective as a collector for gold in an ore flotation process. The tricyclodecenyl mercaptan is tested by itself and in combination with other collectors, namely Ndodecyl mercaptan, distilled decyl mercaptan and crude, undistilled decyl mercaptan. Also tested were a mercaptobenzothiazole collector, and the N-dodecyl mercaptan, distilled decyl mercaptan and crude, undistilled decyl mercaptan collectors by themselves. The effectiveness of the tricyclodecenyl mercaptan as a collector by itself and in combination with other collectors is compared to the effectiveness of the mercaptobenzothiazole and other collectors by themselves.

The mercaptobenzothiazole collector was tested first. The mercaptobenzothiazole collector was a sodium mercaptobenzothiazole/frother blend sold under the trade name "SENKOL 50". The blend comprised approximately 40% by volume active sodium mercaptobenzothiazole and approximately 60% by volume frother.

First, a charge of 400 grams of a pre-ground ore containing iron and gold and an amount of tap water sufficient to make a slurry containing 38% by weight solids was added to a 1.5 liter capacity Denver D-12 flotation cell. The mixture was conditioned for 30 minutes at 1350 rpm. As the mixture was conditioned, an amount of a 10% by weight sulfuric acid solution sufficient to adjust the pH of the slurry to 3.8 was added thereto.

In order to depress pyrophyllite, $Al_2Si_4O_{10}(OH)_2$, 5.6 milliliters (70 grams per ton of ore) of an aqueous solution containing 0.5% by weight of a modified guar gum sold under the trade name "ARCOL J2P 350" was added to the slurry after it was conditioned. Also added to the slurry after it was conditioned were 2 milliliters of an aqueous solution containing 2% by weight of the "SENKOL 50". The amount of the "SENKOL 50" added to the cell was 100 grams per ton of solids. The mixture was then conditioned for 2 minutes.

Next, 0.008 grams (20 grams per ton of ore) of a frother (Dowfroth 200) was added to the cell and the mixture was conditioned for 0.5 minutes. Thereafter, two milliliters (50 grams per ton of ore) of an aqueous solution containing 1% by weight copper sulfate, $CuSO_4$, was added to the cell. The slurry was then floated for 8 minutes and the concentrate was filtered, dried and analyzed. The procedure was repeated and average weight percent recoveries of gold, iron and sulfur were calculated from the two runs.

The procedure was then repeated for the tricyclodecenyl mercaptan, N-dodecyl mercaptan, distilled N-decyl mercaptan and crude, undistilled N-decyl mercaptan collectors by themselves and for the tricyclodecenyl mercaptan collector in combinations with the N-dodecyl mercaptan, distilled decyl mercaptan and crude, undistilled decyl mercaptan collectors. In each run, the procedure was the same as the procedure described above except the other collector or combination of collectors was substituted for the mercaptobenzothiazole collector. The tricyclodecenyl mercaptan collector and other collectors tested were each blended with a dispersing agent consisting of a polypropylene glycol based frother before being employed. The collector/dispersing agent blend contained 75% by volume collector and 25% by volume dispersing agent. When combined, the collectors were employed such that the weight ratio of the tricyclodecenyl mercaptan/dispersant blend to the other collector/blend was 50:50. The total amount of collector/dispersant blend or blends employed in each test was 100 grams per ton of solids. As with the mercaptobenzothiazole collector, each collector and combination of collectors was tested twice and an average weight percent recovery was calculated from the two runs.

The results of the tests are shown in Table I below.

TABLE I

TRICYCLODECENYL MERCAPTAN AS A COLLECTOR FOR GOLD IN ORE FLOTATION

| Run No. | Collector(s) 100 grams per ton | | Wt. % Recovery Au | Fe | S |
|---|---|---|---|---|---|
| 1 | mercaptobenzothiazole[a] | | 69.6 | 63.3 | 85.6 |
| 2 | mercaptobenzothiazole[a] | | 52.1 | 60.5 | 84.7 |
| | | Average: | 60.8 | 61.9 | 85.1 |
| 3 | n-dodecyl mercaptan[b] | | 42.4 | 59.2 | 79.4 |
| 4 | n-dodecyl mercaptan[b] | | 56.9 | 61.3 | 82.6 |
| | | Average: | 49.6 | 60.2 | 81.0 |
| 5 | n-decyl mercaptan, distilled[c] | | 54.5 | 61.7 | 84.7 |
| 6 | n-decyl mercaptan, distilled[c] | | 58.9 | 61.7 | 83.0 |
| | | Average: | 56.7 | 61.7 | 83.9 |
| 7 | n-decyl mercaptan, undistilled[d] | | 6.17 | 61.5 | 83.5 |
| 8 | n-decyl mercaptan, undistilled[d] | | 44.9 | 60.0 | 83.6 |
| | | Average: | 53.3 | 60.8 | 83.6 |
| 9 | tricyclodecenyl mercaptan[e] | | 66.3 | 60.4 | 79.7 |
| 10 | tricyclodecenyl mercaptan[e] | | 62.2 | 61.5 | 82.0 |
| | | Average: | 64.3 | 60.9 | 80.9 |
| 11 | 50% tricyclodecenyl mercaptan[e]/50% n-dodecyl mercaptan[b] | | 65.9 | 59.4 | 80.1 |
| 12 | 50% tricyclodecenyl mercaptan[e]/50% n-dodecyl mercaptan[b] | 61.7 | 59.2 | 82.1 | |
| | | Average: | 63.8 | 59.3 | 81.1 |
| 13 | 50% tricyclodecenyl mercaptan[e]/50% n-decyl mercaptan, distilled[c] | | 53.9 | 61.8 | 84.9 |
| 14 | 50% tricyclodecenyl mercaptan[e]/50% n-decyl mercaptan, distilled[c] | | 62.8 | 59.7 | 81.8 |
| | | Average: | 58.4 | 60.8 | 83.4 |
| 15 | 50% tricyclodecenyl mercaptan[e]/50% n-decyl mercaptan, undistilled[d] | | 48.5 | 59.4 | 83.3 |
| 16 | 50% tricyclodecenyl mercaptan[e]/50% n-decyl mercaptan, undistilled[d] | | 55.6 | 61.0 | 85.2 |
| | | Average: | 52.0 | 60.2 | 84.2 |

[a]A sodium mercaptobenzothiazole/frother blend sold under the trade name "SENKOL 50".
[b]75% by volume n-decyl mercaptan, 25% by volume of a dispersing agent consisting of a polypropylene glycol based frother.
[c]75% by volume n-decyl mercaptan, distilled, 25% by volume of a dispersing agent consisting of a polypropylene glycol based frother.
[d]75% by volume n-decyl mercaptan, undistilled, 25% by volume of a dispersing agent consisting of a polypropylene glycol based frother.
[e]75% by volume tricyclodecenyl mercaptan, 25% by volume of a dispersing agent consisting of a polypropylene glycol based frother.

The results of the tests show that the tricyclodecenyl mercaptan is an effective collector for gold in an ore flotation process. The tricyclodecenyl mercaptan collector led to a significantly higher average weight percent recoveryof gold than the mercaptobenzothizaole collector. The tests show that the tricyclodecenyl mercaptan is a more effective collector than the dodecyl mercaptan and decyl mercaptan (pure and crude) collectors when used by themselves. The tests also show that the tricyclodecenyl mercaptan can be diluted by 50% with either dodecyl or decyl mercaptan and still lead to a satisfactory recovery of gold.

EXAMPLE II

This example shows that a tricyclodecenyl mercaptan formed by the addition of hydrogen sulfide to dicyclopentadiene is effective as a collector for zinc in an ore flotation process. Laboratory tests were conducted to determine the effectiveness of both the tricyclodecenyl mercaptan and sodium N-butyl trithiocarbonate, a known collector. The results of the two tests were compared.

The sodium N-butyl trithiocarbonate was tested first. A charge of 785 grams of a pre-ground ore containing zinc and iron and an amount of tap water sufficient to make a slurry containing approximately 50% by weight solids was added to a 1.1 liter capacity Denver D-12 flotation cell. Thereafter, 8.6 cubic centimeters of an aqueous solution containing 2.2% by weight copper sulfate was added to the cell and the slurry was conditioned for four minutes at 1200 rpm.

Next, 0.0352 grams (0.101 pounds per ton of ore) of an aqueous solution containing 40 percent by weight of the sodium N-butyl trithiocarbonate, and three drops (0.21 grams) (27 grams per ton of ore) of a frother (Dowfroth 1012) were added to the cell and the slurry was conditioned at one minute at 1200 rpm. The slurry was then initially floated for two minutes.

After the initial float, one drop (0.007 grams) (9 grams per ton of ore) of a frother (Dowfroth 1012) was added to the cell and the slurry was floated again, this time for 2.5 minutes. The concentrate was then filtered, dried and analyzed, and weight percent recoveries for zinc and iron were calculated.

The test was then repeated for the tricyclodeconyl mercaptan. The procedure used to conduct the test was the same as the procedure used to conduct the first test except the tricyclodeconyl mercaptan was used instead of the sodium N-butyl trithiocarbonate and one drop (0.007 grams) (9 grams per ton of ore) instead of three drops of the frother (Dowfroth 1012) were added to the cell before the initial float. The amount of the tricyclodecenyl mercaptan used was 0.036 grams (0.104 pounds per ton of ore).

The results of the test are shown in Table II below:

TABLE II

TRICYCLODECENYL MERCAPTAN AS A COLLECTOR FOR ZINC IN ORE FLOTATION

| Test No. | Collector | Wt. % Recovery Zn | Fe |
|---|---|---|---|
| 1 | Sodium N—butyl trithiocarbonate | 91.3 | 19.5 |
| 2 | Tricyclodecenyl mercaptan | 91.8 | 11.4 |

The results of the tests show that a tricyclodecenyl mercaptan prepared by the addition of hydrogen sulfide to dicyclopentadiene is effective as a collector for zinc in an ore flotation process. The tricyclodecenyl mercaptan led to a weight percent recovery of zinc slightly higher than the weight percent recovery of zinc achieved by the sodium N-butyl trithiocarbonate. The tricyclodecenyl mercaptan was more selective for zinc over iron than the sodium N-butyl trithiocarbonate.

The preceding examples can be repeated with similar success by substituting the generically or specifically described reactants and/or operating conditions of this invention for those used in the example.

From the foregoing description, one skilled in the art can easily ascertain the essential characteristics of the invention, and without departing from the scope and spirit thereof, can make various changes and modifications of the invention to adapt it to various usages and conditions.

What is claimed is:

1. In a process for the recovery of a metal containing mineral from an ore or concentrate containing said mineral wherein the mineral is recovered in a froth from an aqueous flotation pulp containing the ore or concentrate, said process comprising subjecting said ore or concentrate to froth flotation, wherein a mineral floation agent is employed in the aqueous flotation pulp in an amount sufficient to control the type of minerals in the froth, the improvement comprising employing as said mineral flotation agent a compound formed by the chemical reaction of hydrogen sulfide with dicyclopentadiene.

2. The process of claim 1 wherein said compound employed as said mineral flotation agent is employed in an amount in the range of from about 0.005 pound to about 5 pounds per ton of solids in the pulp.

3. The process of claim 1 wherein said compound employed as said mineral flotation agent is employed in an amount in the range of from about 0.01 pound to about 0.5 pound per ton of solids in the pulp.

4. The process of claim 1 wherein said compound employed as said mineral flotation agent is a tricyclodecenyl mercaptan and is employed in combination with an additional mineral flotation agent selected from the group consisting of a decyl mercaptan and a dodecyl mercaptan.

5. The process of claim 4 wherein said tricyclodecenyl mercaptan and said additional mineral flotation agent are employed in amounts such that the weight ratio of tricyclodecenyl mercaptan to the additional collector is in the range of from 50:50 to 99.9:0.1.

6. The process of claim 1 wherein said metal comprises gold and wherein said compound employed as said mineral flotation agent is employed as a mineral flotation collector to increase the amount of gold in the froth.

7. A process for recovering a metal containing mineral comprising:

(a) mixing crushed ore containing gold metal containing mineral, water and a mineral flotation agent to establish a pulp, said mineral flotation agent comprising a tricyclodecenyl mercaptan formed by the chemical reaction of hydrogen sulfide with dicyclopentadiene; and (b) subjecting the established pulp to froth flotation by aerating the thus established pulp to produce a froth containing said mineral.

8. The process of claim 7 wherein said tricyclodecenyl mercaptan employed as said mineral flotation agent is employed in an amount in the range of from about 0.005 pound to about 5 pounds per ton of solids in the pulp.

9. The process of claim 7 wherein said tricyclodecenyl mercaptan employed as said mineral flotation agent is employed in an amount in the range of from about 0.01 pound to about 0.5 pound per ton of solids in the pulp.

10. The process of claim 7 wherein said tricyclodecenyl mercaptan employed as said mineral flotation agent is employed in combination with an additional collector selected from the group consisting of a decyl mercaptan and a dodecyl mercaptan.

11. The process of claim 10 wherein said tricyclodecenyl mercaptan and said additional mineral flotation agent are employed in amounts such that the weight ratio of tricyclodecenyl mercaptan to the additional collector is in the range of from 50:50 to 99.9:0.1.

12. The process of claim 7 wherein said metal comprises gold and wherein said tricyclodecenyl mercaptan employed as said mineral flotation agent is employed as a mineral flotation collector to increase the amount of gold in the froth.

13. The process of claim 7 wherein said tricyclodecenyl mercaptan employed as said mineral flotation agent is represented by a formula selected from the group consisting of:

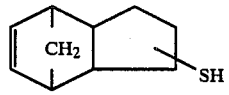

and

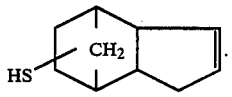

14. In a process for the recovery of a metal containing mineral from an ore or concentrate containing said mineral wherein the mineral is recovered in a froth from an aqueous flotation pulp containing the ore or concentrate, said process comprising subjecting said ore or concentrate to froth flotation wherein a mineral flotation agent is employed in the aqueous flotation pulp in an amount sufficient to control the type of minerals in the froth, the improvement comprising employing as said mineral flotation agent a tricyclodecenyl mercaptan represented by a formula selected from the group consisting of:

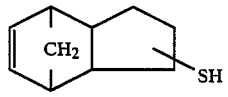

and

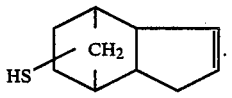

15. The process of claim 14 wherein said tricyclodecenyl mercaptan employed as said mineral flotation agent is employed in an amount in the range of from about 0.005 pound to about 5 pounds per ton of solids in the pulp.

16. The process of claim 14 wherein said tricyclodecenyl mercaptan employed as said mineral flotation agent is employed in an amount in the range of from about 0.01 pound to about 0.5 pound per ton of solids in the pulp.

17. The process of claim 14 wherein said tricyclodecenyl mercaptan employed as said mineral flotation agent is employed in combination with an additional mineral flotation agent selected from the group consisting of a decyl mercaptan and a dodecyl mercaptan.

18. The process of claim 17 wherein said tricyclodecenyl mercaptan and said additional collector are employed in amounts such that the weight ratio of tricyclodecenyl mercaptan to the additional collector is in the range of from 50:50 to 99.9:0.1.

19. The process of claim 14 wherein said metal comprises gold and wherein said tricyclodecenyl mercaptan employed as said mineral flotation agent is employed as a mineral flotation collector to increase the amount of gold in the froth.

* * * * *

UNITED STATES PATENT AND TRADEMARK OFFICE

CERTIFICATE OF CORRECTION

PATENT NO. : 4,857,179

DATED : August 15, 1989

INVENTOR(S) : Kenneth B. Kimble, Gary D. Macdonell and Harold W. Mark

It is certified that error appears in the above-identified patent and that said Letters Patent is hereby corrected as shown below:

Column 1, line 65, delete "agent" and substitute --agent(s)-- therefor;

Column 3, line 57, delete "viceversa" and substitute --vice-versa-- therefor;

Column 5, line 65, delete "Ndodecyl" and substitute --N-dodecyl-- therefor;

Column 7, line 54, delete "recoveryof" and substitute --recovery of-- therefor;

Column 9, lines 3 and 4, delete "floation" and substitute --flotation-- therefor; and Column 9, line 36, delete "gold" and substitute --said-- therefor.

Signed and Sealed this

Thirty-first Day of July, 1990

*Attest:*

*Attesting Officer*

HARRY F. MANBECK, JR.

*Commissioner of Patents and Trademarks*